US011123627B2

(12) United States Patent
Ferrari et al.

(10) Patent No.: US 11,123,627 B2
(45) **Date of Patent: *Sep. 21, 2021**

(54) VENTED SHIN GUARD

(71) Applicant: Dick's Sporting Goods, Inc., Coraopolis, PA (US)

(72) Inventors: Lucas Ferrari, Pittsburgh, PA (US); Charles Larson, Coraopolis, PA (US); Chinawut Paesang, Sewickley, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 134 days.

This patent is subject to a terminal disclaimer.

(21) Appl. No.: 16/263,154

(22) Filed: Jan. 31, 2019

(65) Prior Publication Data

US 2019/0160362 A1 May 30, 2019

Related U.S. Application Data

(63) Continuation of application No. 15/359,354, filed on Nov. 22, 2016, now Pat. No. 10,195,512.

(60) Provisional application No. 62/258,813, filed on Nov. 23, 2015.

(51) Int. Cl.

| | |
|---|---|
| ***A41D 13/05*** | (2006.01) |
| ***A41D 13/015*** | (2006.01) |
| ***A63B 71/12*** | (2006.01) |

(52) U.S. Cl.

CPC ..... *A63B 71/1225* (2013.01); *A41D 13/0158* (2013.01); *A41D 13/0543* (2013.01); *A63B 2071/1258* (2013.01); *A63B 2209/10* (2013.01)

(58) Field of Classification Search

CPC ..... A63B 71/1225; A41D 13/0158; A41D 13/0543

USPC ..... 2/22

See application file for complete search history.

(56) References Cited

U.S. PATENT DOCUMENTS

| | | | | |
|---|---|---|---|---|
| 2,553,612 A | | 5/1951 | Taylor | |
| 5,384,913 A | | 1/1995 | Hendry | |
| 5,405,312 A | * | 4/1995 | Jacobs | A41D 13/0568 128/892 |
| 5,530,966 A | * | 7/1996 | West | A61P 37/00 2/462 |
| 5,732,713 A | | 3/1998 | Duback et al. | |
| 7,082,621 B1 | | 8/2006 | Fratesi | |

(Continued)

FOREIGN PATENT DOCUMENTS

| | | |
|---|---|---|
| CN | 1418715 A | 5/2003 |
| CN | 2620568 Y | 6/2004 |

(Continued)

OTHER PUBLICATIONS

ISA/US, International Search Report and Written Opinion issued on PCT application No. US16/63391, dated Feb. 2, 2017, 12 pages.

*Primary Examiner* — Gloria M Hale
(74) *Attorney, Agent, or Firm* — Fox Rothschild LLP

(57) ABSTRACT

A compliant shin guard includes an outer shell composed of an impact absorbing material and an inner padding mounted to the inner surface of the outer shell. A plurality of vents extend through the outer shell and the inner padding, the plurality of vents being distributed across the outer surface of the outer shell. A raised channel extends at least partially along the length of the outer shell to provide rigidity to the outer shell.

18 Claims, 8 Drawing Sheets

(56) References Cited

U.S. PATENT DOCUMENTS

| | | | | |
|---|---|---|---|---|
| 7,937,768 | B2 | 5/2011 | Behrend et al. | |
| 10,195,512 | B2 * | 2/2019 | Ferrari | A41D 13/0543 |
| 2003/0088900 | A1 | 5/2003 | Cho | |
| 2006/0096000 | A1 | 5/2006 | Romero et al. | |
| 2007/0214538 | A1 | 9/2007 | Castonguay et al. | |
| 2008/0134419 | A1 * | 6/2008 | Kalaam | A41D 13/00 2/463 |
| 2009/0276943 | A1 | 11/2009 | Balolia | |
| 2012/0198594 | A1 | 8/2012 | Reay | |
| 2013/0232674 | A1 | 9/2013 | Behrend et al. | |
| 2013/0234376 | A1 | 9/2013 | Frey et al. | |
| 2014/0259322 | A1 | 9/2014 | Henry | |
| 2014/0359912 | A1 * | 12/2014 | Sutton | A41D 13/015 2/16 |
| 2016/0327113 | A1 * | 11/2016 | Shelley | G02C 5/008 |
| 2017/0144053 | A1 * | 5/2017 | Ferrari | A41D 13/0158 |

FOREIGN PATENT DOCUMENTS

| | | | |
|---|---|---|---|
| CN | 1833744 | A | 9/2006 |
| DE | 9307949 | U1 | 9/1993 |
| GB | 671022 | A | 4/1952 |
| JP | 2004209113 | A | 7/2004 |

* cited by examiner

VENTED SHIN GUARD

CROSS REFERENCE TO RELATED APPLICATION

This application claims priority to and is a continuation of U.S. patent application Ser. No. 15/359,354 filed Nov. 22, 2016, now U.S. Pat. No. 10,195,512, issued Feb. 5, 2019, which claims priority to U.S. Provisional Application No. 62/258,813, filed Nov. 23, 2015, the disclosures of which are incorporated herein by reference in their entireties.

FIELD OF THE DISCLOSURE

The present description relates generally to athlete body protection equipment and more particularly to a vented shin guard.

BACKGROUND OF RELATED ART

Shin guards are generally well known in the art. Traditionally, a shin guard is used by an athlete to protect the shin region of the athlete from an impact. For example, a shin guard may be worn by a soccer player to protect the player against impact associated with being kicked by another player. Oftentimes, a shin guard includes a hard outer shell to provide rigidity and protection, in combination with an interior padding to be worn between the outer shell and the player's shin to provide comfort and cushioning against the skin.

The National Operating Committee on Standards for Athletic Equipment ("NOCSAE") develops performance standards for protective equipment used in a variety of sports, such as soccer. This standard specification establishes performance requirements for new soccer shin guards as supplied by manufacturers. Due to the safety requirements, shin guards meeting the protective performance standards of NOCSAE oftentimes are bulky, heavy, inadequately vented, or otherwise unconformable to the wearer.

Thus, there is an identifiable need for a shin guard that meets established safety standards, while providing for comfort and usability to the athlete.

DETAILED DESCRIPTION

Figure 1:
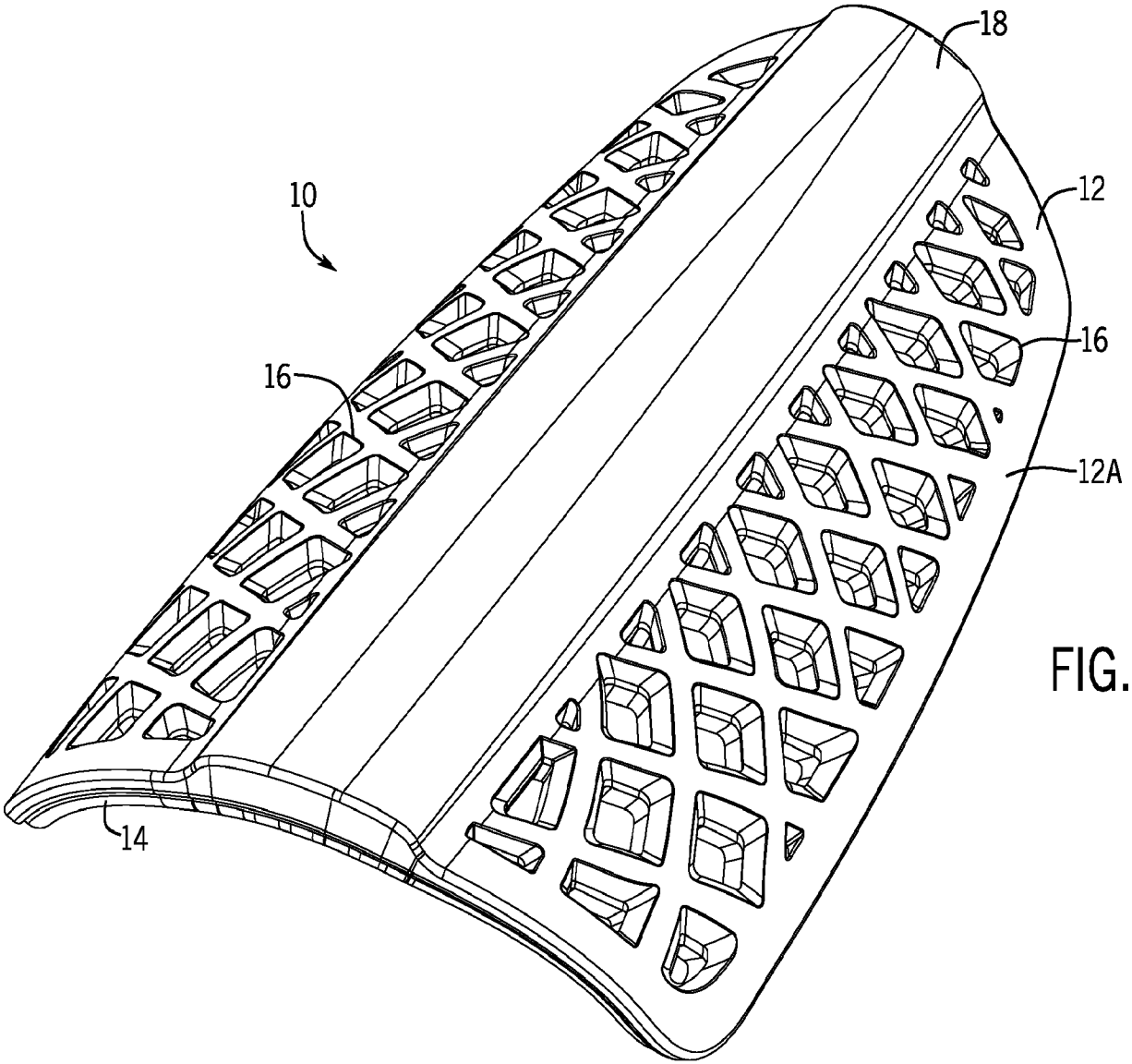
FIG. 1 is a perspective view of an example vented shin guard in accordance with the present disclosure.
Figure 2:
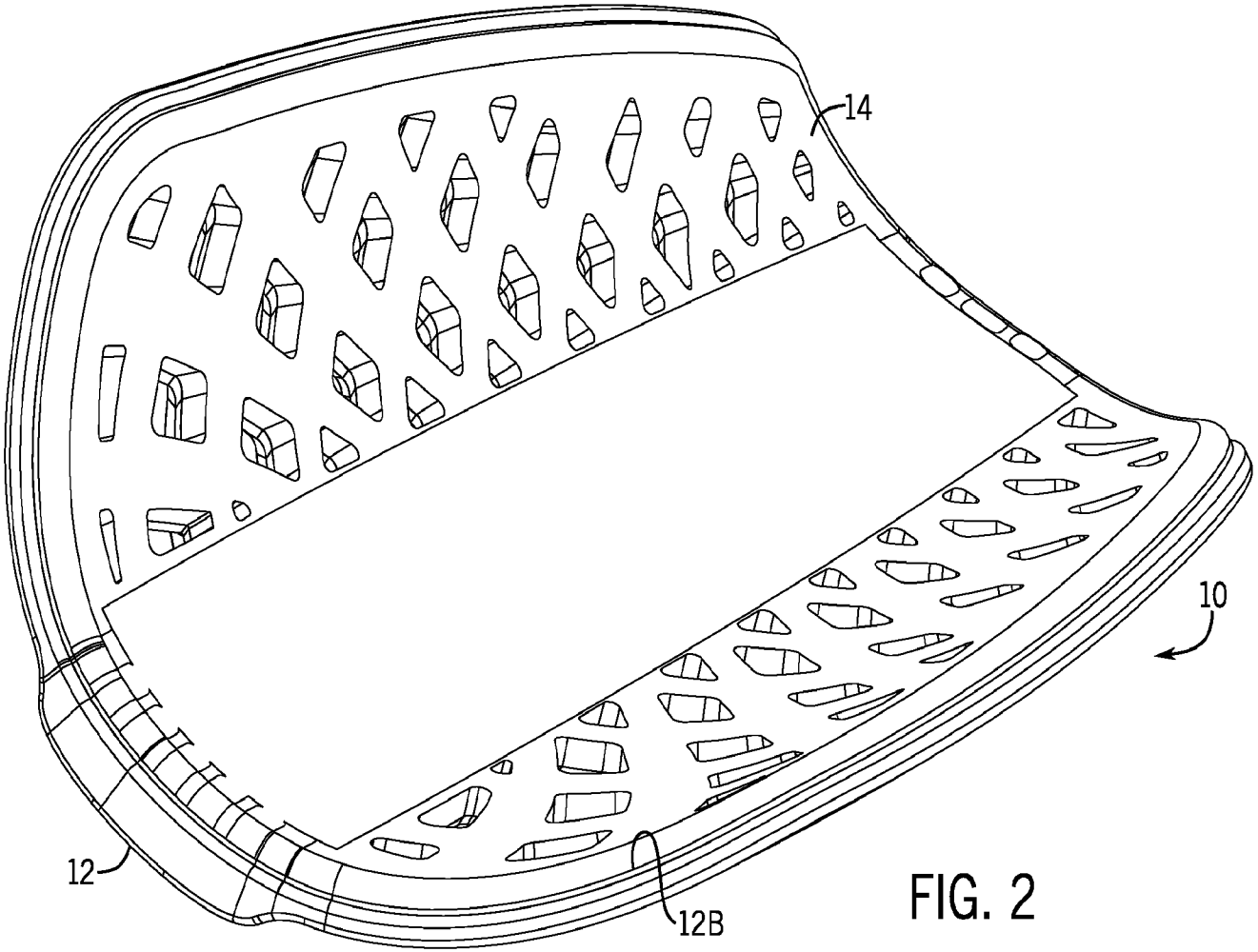
FIG. 2 is a reverse perspective view of the example vented shin guard.
Figure 3:
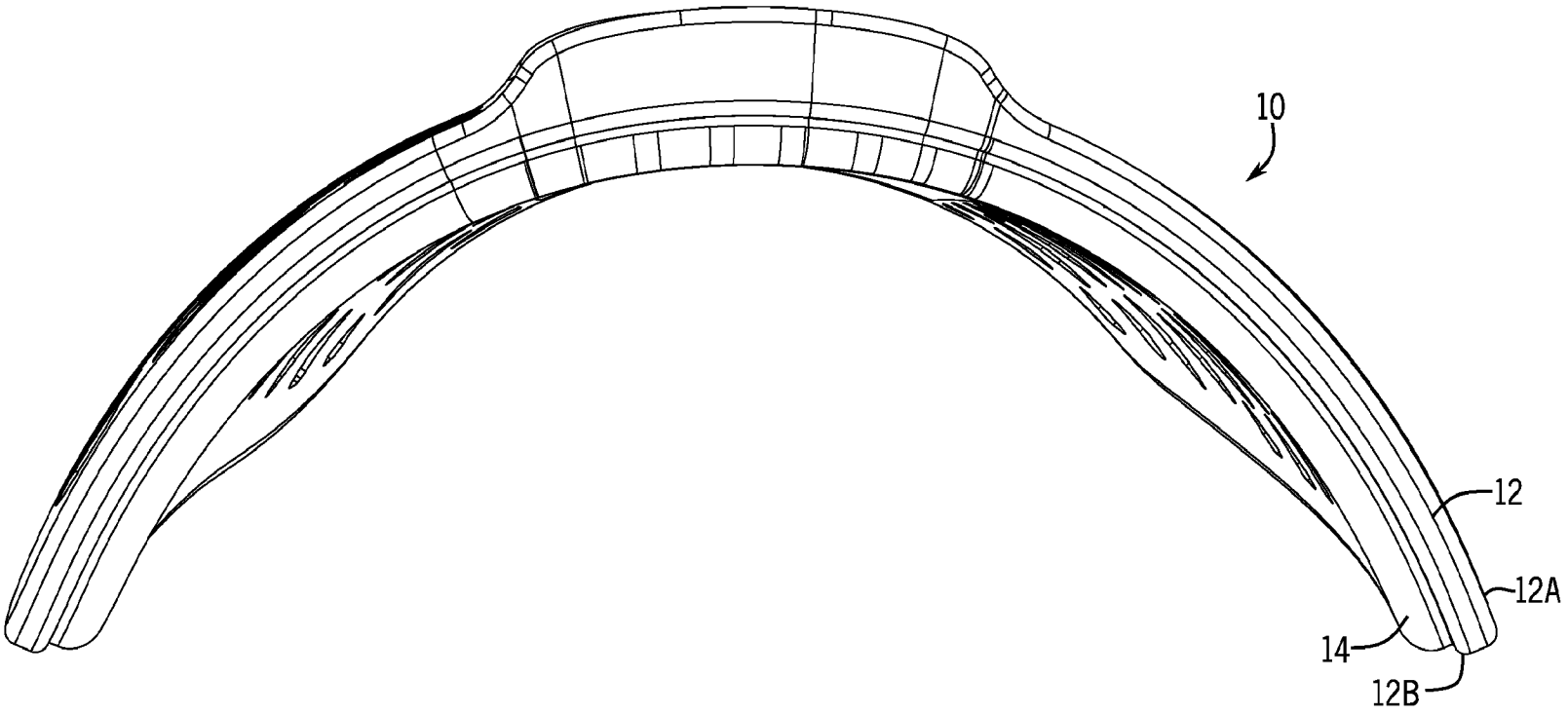
FIG. 3 is a plan view of the example vented shin guard.

The following description of example methods and apparatus is not intended to limit the scope of the description to the precise form or forms detailed herein. Instead the following description is intended to be illustrative so that others may follow its teachings.

Referring now to the figures, there is illustrated an example vented shin guard 10 in accordance with the teachings of the present disclosure. The example shin guard 10 comprises an outer shell 12 having an outer surface 12A and an inner surface 12B and an inner padding 14 coupled to the inner surface 12B of the outer shell 12. Together, the outer shell 12 and the inner padding 14 are configured and adapted to be wearable about and/or conform to a wearer's leg. The example outer shell 12 may be formed with any suitable impact absorbing material, such as for instance, plastic, carbon fiber, etc. Meanwhile, the inner padding 14 may be any suitable padding and/or lining such as a foam or other suitable material. When in use, the example shin guard 10 may be worn by an athlete over their shin region. For instance, the shin guard 10 may be worn inside a player's sock, with the inner padding 14 being placed next to the player's skin. While not illustrated, the shin guard 10 may include additional elements such as securement straps to wrap around a wearer's leg, specialized socks to locate and retain the shin guard on the leg, and/or ankle protectors as desired.

As will be appreciated by one of ordinary skill in the art, the outer shell 12 may be impacted during normal use, such as for instance during an athletic competition. More particularly, the outer shell 12 may be kicked and/or otherwise impacted by other players, the ball, or other equipment. To protect against injury, the outer shell 12 and the inner padding 14 should meet various minimal requirements, such as for instance the standards of NOCSAE, while providing for player comfort.

The example outer shell 12 includes a plurality of vents 16 distributed in a generally cross-hashed pattern. The example cross-hashed pattern provides the strength necessary to meet safety standards, while allowing significant ventilation through the outer shell 12. This ventilation and ventilation pattern may assist in cooling the skin of the wearer and may also assist in odor control. As can be seen in FIGS. 4A-5B, the example vents 16 are generally diamond shaped and inset flush with or below the outer surface 12A of the outer shell 12. In one example, the example vents 16 each include a chamfered edge 17 along at least a portion of the vent perimeter, which allow the vents 16 to appear larger, yet still allow the shell 12 to provide the necessary impact protection strength. More specifically, the example chamfered vents 16 help disperse impact energy when contacted directly or proximate a vent 16. It will be understood that the number, size, shape, pattern, and profile of each of the vents 16 may vary as desired. For example, in some instances, the example vents 16 may or may not include a chamfered edge 17.

Figure 6:
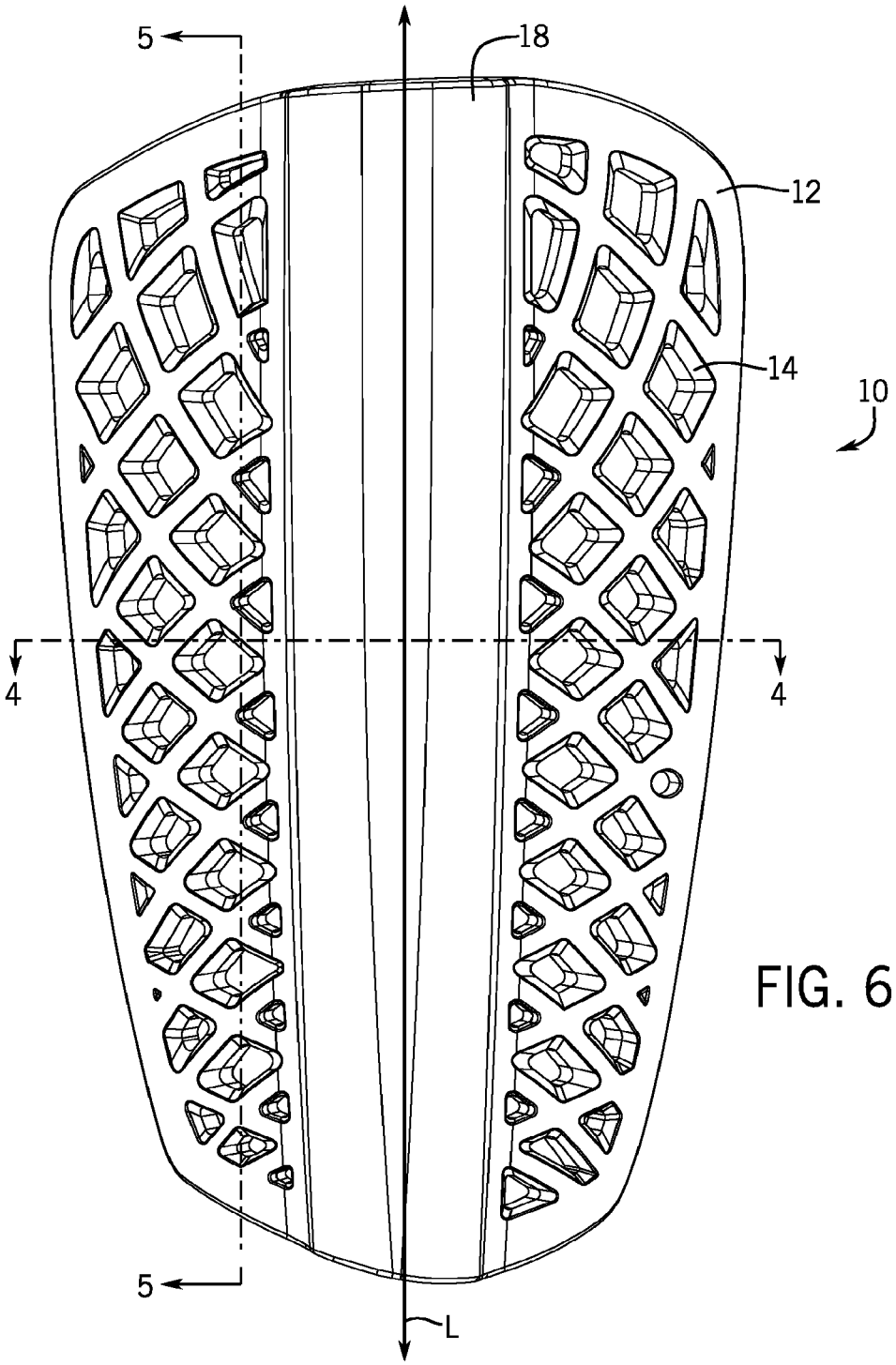
FIG. 6 is an elevation view of the example vented shin guard.

In addition to the example vents 16, the example outer shell 12 defines a raised channel 18, which in this example extends along a central longitudinal axis L of the outer shell 12 (see FIG. 6). In this example, the channel comprises an arched cross-sectional area. It will be understood that the length, width, contour, and/or location of the channel 18 may vary as necessary or desired. For instance, in the present example, the channel 18 extends substantially the entire length of the outer shell 12, and is substantially the same width along the entire length. It will be appreciated, however, that the channel 18 need not be located centrally along the longitudinal axis, but rather may be offset from the axis, may be of varying width and/or length, and/or may include multiple channels distributed about the outer shell.

Figure 4A:
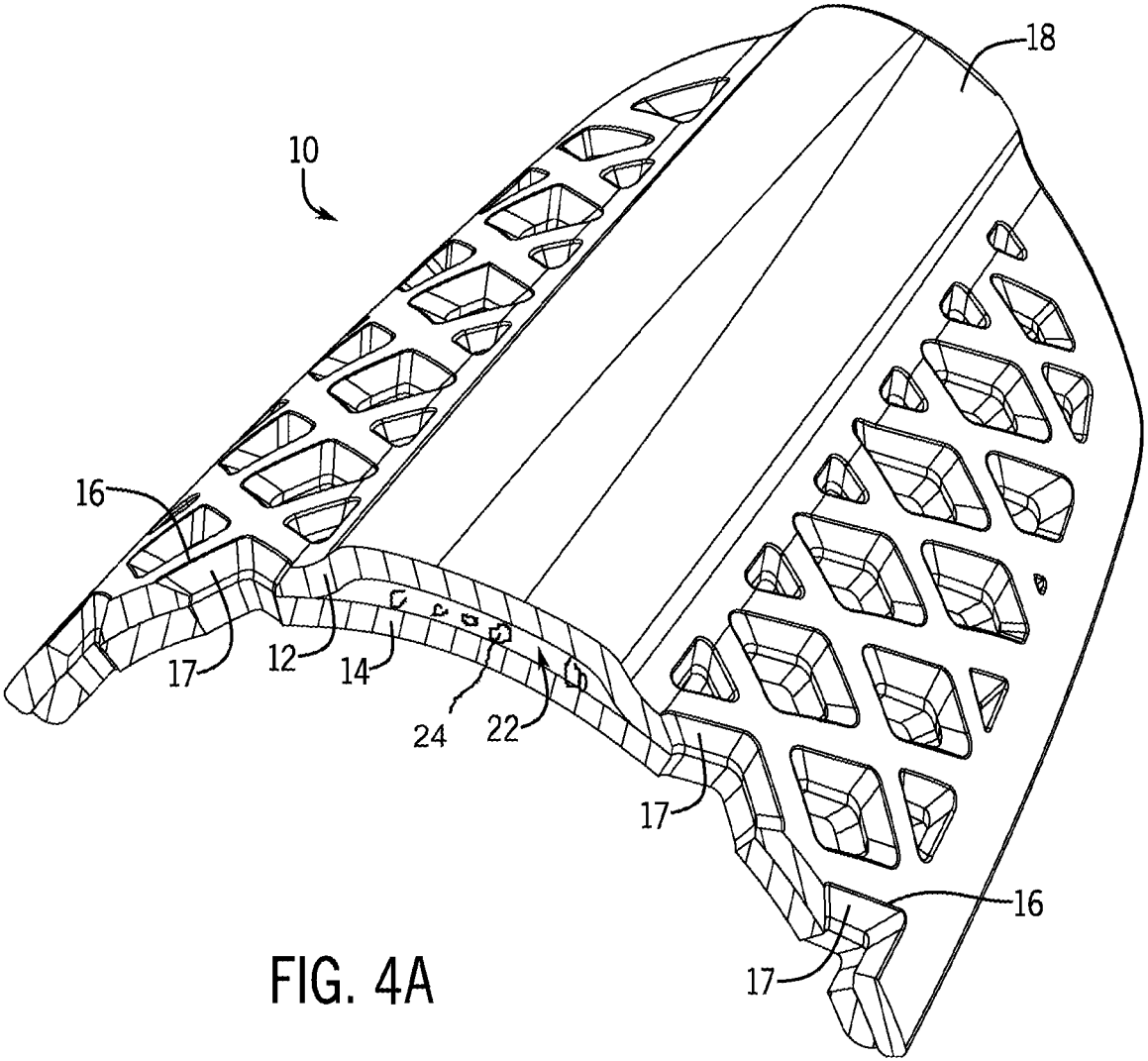
FIG. 4A is a cross-sectional perspective view of the example vented shin guard taken along line 4-4 of FIG. 6.
Figure 4B:
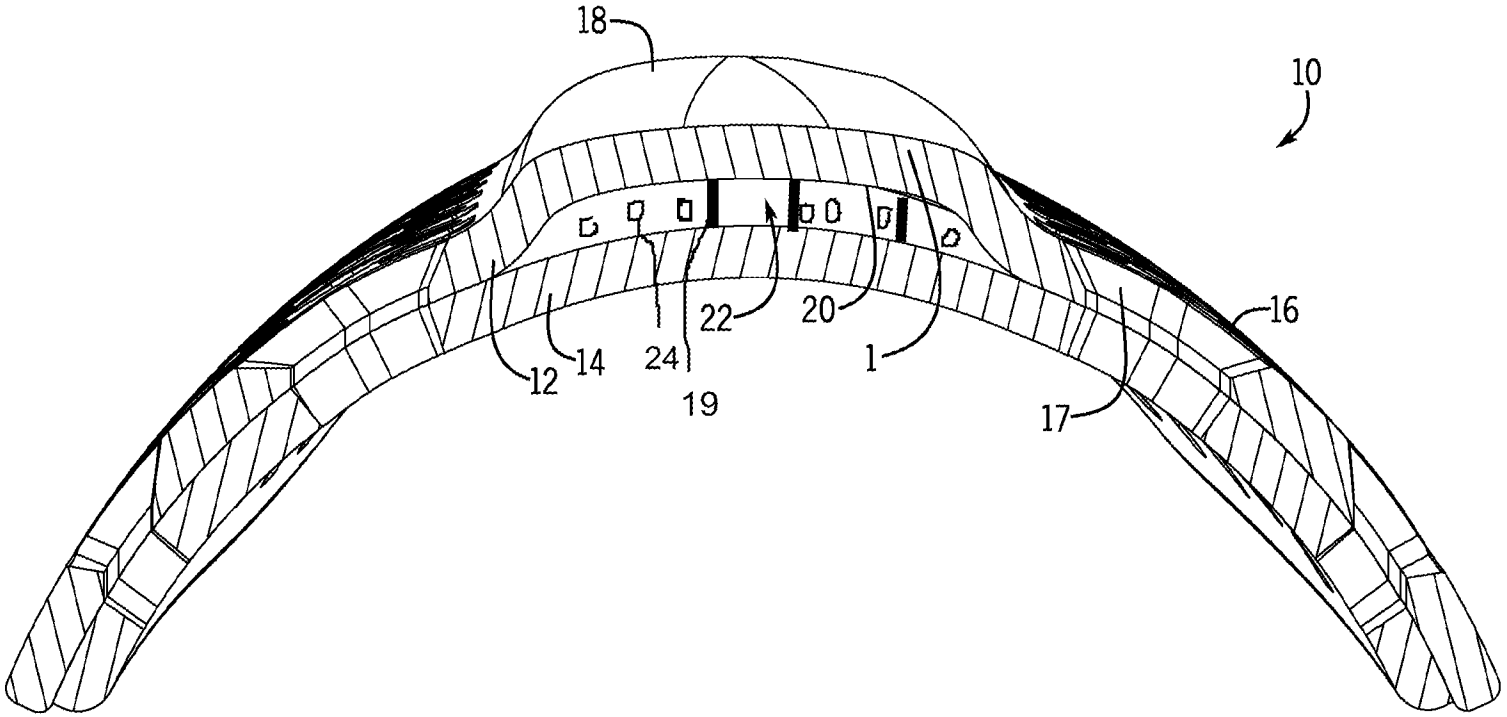
FIG. 4B is a cross-sectional plan view of the example vented shin guard taken along line 4-4 of FIG. 6.
Figure 5A:
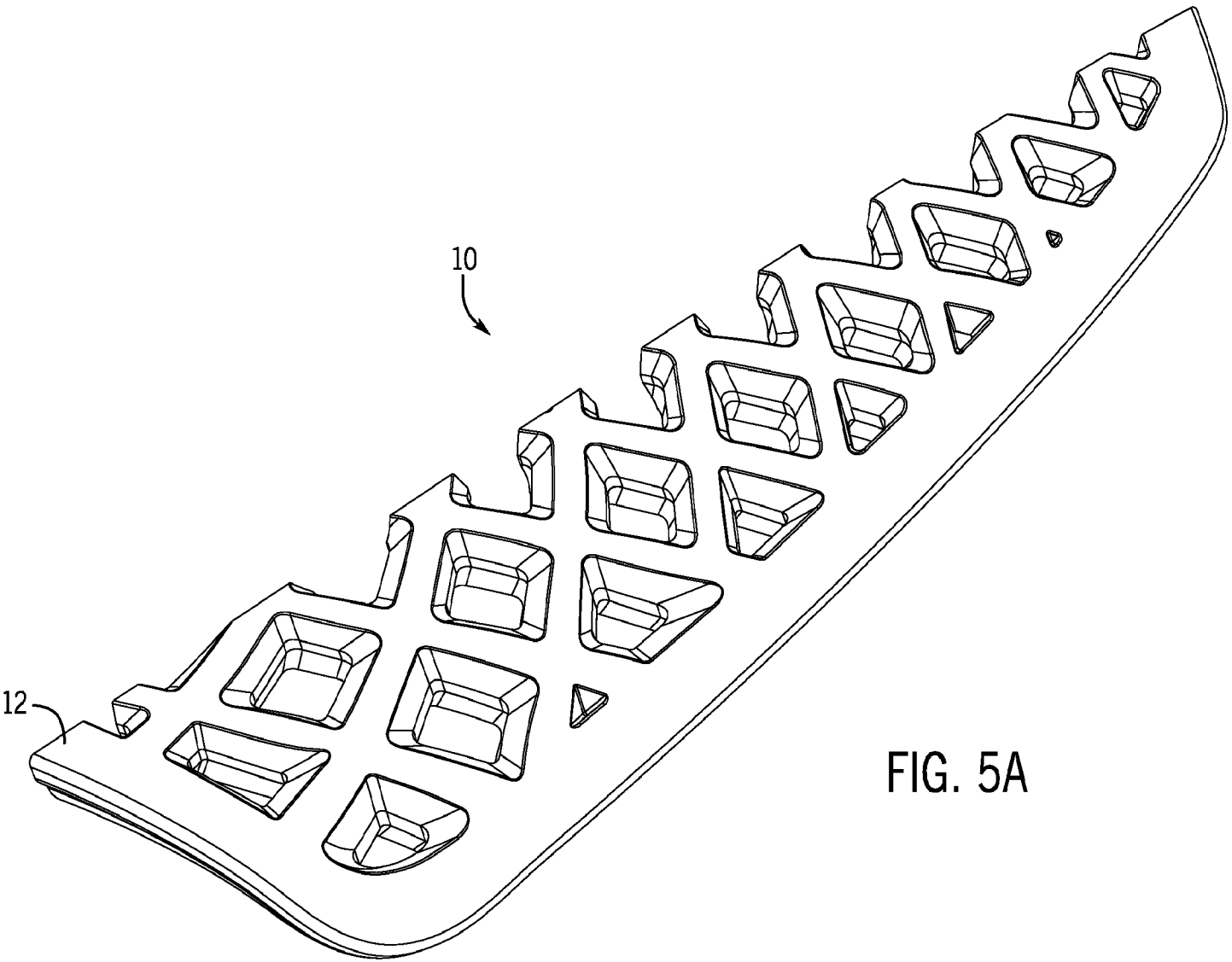
FIG. 5A is a cross-sectional perspective view of the example vented shin guard taken along line 5-5 of FIG. 6.
Figure 5B:
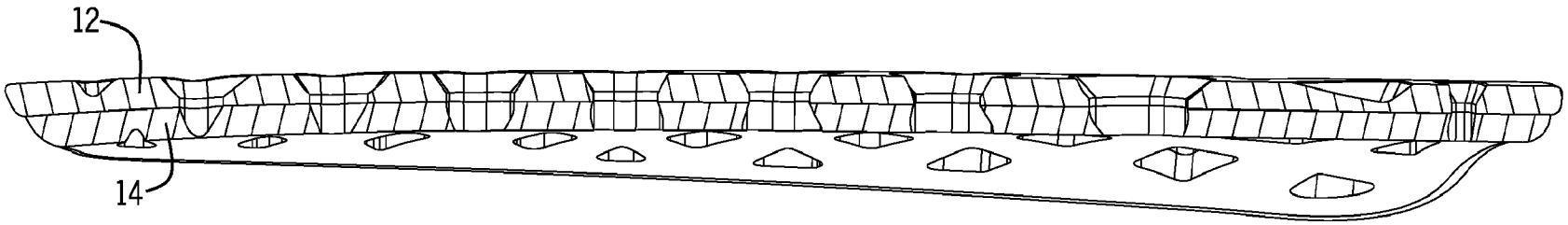
FIG. 5B is a cross-sectional elevation view of the example vented shin guard taken along line 5-5 of FIG. 6.

In this disclosure, the example channel 18 is contoured for center impact absorption. In particular, NOCSAE standards dictate that the heaviest collision protection should be located in the center of the shin guard, which typically rests over the shin bone of the wearer. To assist in accomplishing this protective goal, the example channel 18 includes a recessed rear surface 20 as best illustrated in FIG. 4B. Together, the recessed rear surface 20 and the inner padding 14 define a hollow 22. The hollow 22 helps to maintain a durable, safe center impact and shin bone protection zone.

It will be appreciated that in other examples, this recessed rear surface 20 may be essentially completely hollow, may include strengthen elements such as ribs 19, or may be otherwise contoured for performance. Still further, the recessed rear surface may be partially or completely eliminated and thus the inner surface of the outer shell 12 may be substantially flat throughout. Still further, in other example, the hollow 22 may be at least partially filled with a additional material, such as for instance, a foam and/or other suitable material 24. For instance, the hollow 22 may be at least partially filled with a foam 24 having a different durometer from the inner padding 14.

The inner padding 14 may be adhered to, integrally formed with, or otherwise mounted to the inside surface of the outer shell 12 as desired. Furthermore, it will be appreciated that the connection between the padding 14 and the shell 12 may be permanent, semi-permanent, or releasable as desired. For example, the inner padding 14 may comprise a washable or otherwise cleanable material that can be detached from the shell 12 for laundering. For instance, the inner padding 14 may be adhered to the outer shell 12 with a traditional adhesive substance, such as glue, or a releasable material such as a hook and loop material.

In the example shin guard 10, the actual adhesion of the EVA Foam padding 14 to the shell 12 occurs proximate the perimeter area of the two elements, i.e., around the outside edges of the two elements. In order to better accommodate the adhesive in the present design, the example shin guard 10 comprises a substantially flat smooth surface facing the outer shell 12 around the edge of the padding 14 so that the foam can be glued securely to the shin. In the present example, the substantially flat surface is approximately 8 mm in width. Of course, as noted, the size, width, and/or location of the adhesion points may be varied as needed or desired.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A shin guard comprising:

an outer shell comprising an impact absorbing material, the outer shell having an outer surface and an inner surface, the inner surface being contoured to conform to a shin of a wearer, the outer shell further having a longitudinal axis extending a length of the outer shell;

an inner padding mounted to the inner surface of the outer shell;

a plurality of vents in a generally cross-hatched pattern having openings extending through the outer shell and the inner padding; and a raised channel extending at least partially along the length of the outer shell, wherein the inner padding is mounted to the outer shell to define a hollow that is at least partially filled with a material that has one or more properties different from those of the inner padding.

2. The shin guard of claim 1, wherein the raised channel does not include the plurality of vents.

3. The shin guard as recited in claim 1, wherein at least some of the plurality of vents are diamond shaped.

4. The shin guard as recited in claim 1, wherein at least some of the plurality of vents are inset at least one of flush with or below the outer surface of the outer shell.

5. The shin guard as recited in claim 1, wherein at least some of the plurality of vents includes a chamfered edge along a portion of the perimeter of the vent.

6. The shin guard as recited in claim 1, wherein a longitudinal axis of the raised channel is offset from the longitudinal axis of the outer shell.

7. The shin guard as recited in claim 1, wherein a longitudinal axis of the raised channel is coaxial with the longitudinal axis of the outer shell.

8. The shin guard as recited in claim 1, wherein the raised channel extends the length on the outer shell.

9. The shin guard as recited in claim 1, wherein the raised channel includes an arch-shaped cross sectional area.

10. The shin guard as recited in claim 1, wherein the raised channel has a width, and the width of the raised channel is the same along a length of the raised channel.

11. The shin guard as recited in claim 1, wherein the outer shell comprises a plurality of raised channels.

12. The shin guard as recited in claim 1, wherein the hollow is between the inner padding and an inner surface of the raised channel.

13. The shin guard as recited in claim 12, wherein the hollow is configured to be located over a shin bone of the shin of the wearer.

14. The shin guard as recited in claim 12, wherein the hollow comprises strengthening elements.

15. The shin guard as recited in claim 12, wherein the material comprises foam having a durometer that is different from that of the inner padding.

16. The shin guard as recited in claim 1, wherein the inner padding is releasably mounted to the inner surface of the outer shell.

17. A shin guard comprising:

an outer shell comprising an impact absorbing material, the outer shell having an outer surface and an inner surface, the inner surface being contoured to conform to a shin of a wearer, the outer shell further having a longitudinal axis extending a length of the outer shell;

an inner padding mounted to the inner surface of the outer shell, wherein a perimeter of the inner padding comprises a flat surface for secure mounting of the inner padding to the outer shell;

a plurality of vents in a generally cross-hatched pattern having openings extending through the outer shell and the inner padding; and a raised channel extending at least partially along the length of the outer shell, wherein the inner padding is mounted to the outer shell to define a hollow that is at least partially filled with a material that has one or more properties different from those of the inner padding.

18. The shin guard as recited in claim 17, wherein the inner padding is permanently mounted to the inner surface of the outer shell via an adhesive applied between the inner surface of the outer shell and the flat surface of the inner padding.

* * * * *